US005890306A

United States Patent [19]

Smith

[11] Patent Number: 5,890,306

[45] Date of Patent: Apr. 6, 1999

[54] STREET NUMBER DISPLAY

[76] Inventor: Patric Nelson Smith, 20677 Patton Ct., Detroit, Mich. 48228

[21] Appl. No.: 769,767

[22] Filed: Dec. 19, 1996

Related U.S. Application Data

[60] Provisional application No. 60/009,115, Dec. 22, 1995.

[51] Int. Cl. [6] ..... G09F 13/04

[52] U.S. Cl. ..... 40/576; 40/618; 40/617

[58] Field of Search ..... 40/576, 618, 564, 40/568, 575, 585, 620, 617, 595; 434/175; 362/812

[56] References Cited

U.S. PATENT DOCUMENTS

| | | | |
|---|---|---|---|
| 1,382,267 | 6/1921 | Bissell . | |
| 1,511,791 | 10/1924 | Weinberg | 40/568 |
| 1,568,630 | 1/1926 | Shearer | 40/576 |
| 1,747,400 | 2/1930 | Stewart et al. | 40/576 |
| 1,799,055 | 3/1931 | Mercer . | |
| 2,299,672 | 10/1942 | Willer . | |
| 2,893,148 | 7/1959 | Figman . | |
| 3,968,584 | 7/1976 | Kingston . | |
| 4,254,457 | 3/1981 | Lordier . | |
| 4,611,265 | 9/1986 | Davis . | |
| 4,765,080 | 8/1988 | Conti | 40/576 |
| 4,807,378 | 2/1989 | Bell . | |
| 4,848,017 | 7/1989 | Bailey et al. | 40/576 |
| 4,939,858 | 7/1990 | Dailey | 40/762 X |
| 4,953,067 | 8/1990 | Moore . | |
| 5,454,181 | 10/1995 | Rothman et al. | 40/576 X |

FOREIGN PATENT DOCUMENTS

| | | | |
|---|---|---|---|
| 575499 | 7/1924 | France | 40/576 |
| 541635 | 4/1956 | Italy | 434/175 |

*Primary Examiner*—Brian K. Green

*Attorney, Agent, or Firm*—Gifford, Krass, Groh, Sprinkle, Anderson & Citkowski, P.C.

[57] ABSTRACT

A street number display for mounting to a building in either a horizontal or vertical alignment. The street number display includes a housing, a face plate having an opening and square character plates which are mounted to the face plate. The square character plates may be arranged to be read in either a vertical or horizontal alignment, thereby permitting the housing to be mounted either vertically or horizontally on the building. A light activated switch is provided to energize or deenergize the light at nightfall.

7 Claims, 1 Drawing Sheet

STREET NUMBER DISPLAY

BACKGROUND OF THE INVENTION

This application takes priority from Provisional application Ser. No. 60/009,115, filed Dec. 22, 1995.

I. Field of the Invention

The invention relates to street number displays and, more particularly, to character blanks for lighted displays.

II. Description of the Prior Art

Street number displays for mounting to a building, such as those disclosed in U.S. Pat. No. 2,893,148, are well known. The display includes a housing which contains a light source and has a horizontal opening along the front side. The street number is formed by lenses which are mounted to the light source and viewed through the opening in the housing.

U.S. Pat. No. 4,254,457 discloses an illuminated sign construction for displaying house numbers. The house numbers are formed by mounting rectangular indicia blanks to the housing. The blanks have an opaque mask surrounding a transparent area to form the desired numeral. The indicia blanks are slid in rails formed in the housing to cover an elongated horizontal opening. The indicia blanks are backlit by a light source mounted in the housing.

However, in many situations it is desirable to mount the number display in a vertical alignment. Previously known horizontal street number displays are unsuitable for mounting in a vertical alignment because the dimensions of the opening and the use of rectangular character blanks. The characters must be smaller for vertical alignment than horizontal alignment if the rectangle is rotated 90°. Accordingly, displays with different dimensions are produced for vertical alignment.

It is therefore an object of this invention to provide a lighted street number display which can be mounted in either a horizontal or vertical alignment and utilize the same set of number blanks.

SUMMARY OF THE INVENTION

The invention includes an elongated housing, a face plate and a plurality of square character plates. The housing has an interior chamber for mounting a source of light, such as a pair of fluorescent bulbs and a ballast. The face plate has a rectangular opening. Mounting clips are provided to secure the character plates to the rear of the face plate. The character plates are square and may be affixed in either a horizontal or vertical alignment. The face plate is mounted over an opening in the housing, permitting the display to be mounted to the building in either horizontal or vertical alignment. Additionally, the housing may be provided with a light sensitive switch for automatically activating and deactivating the light source on the number display.

Further objects and advantages of the present invention will be apparent from the following description, reference being had to the accompanying drawings wherein a preferred embodiment of the invention is clearly shown.

DETAILED DESCRIPTION OF THE PREFERRED EMBODIMENT

Figure 1:
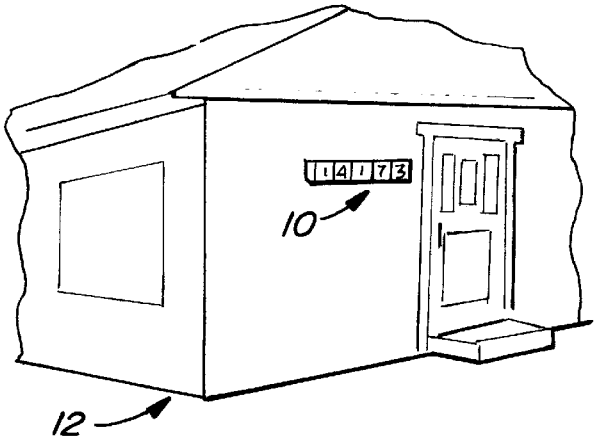
FIG. 1 is a perspective view of the street number display in accordance with the invention mounted to a building in a horizontal alignment.
Figure 2:
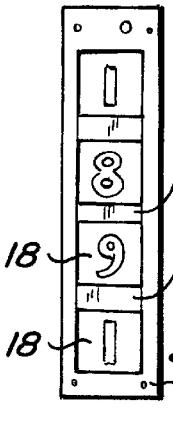
FIG. 2 is a front view of a street number display in accordance with the invention shown in a vertical alignment.
Figure 3:
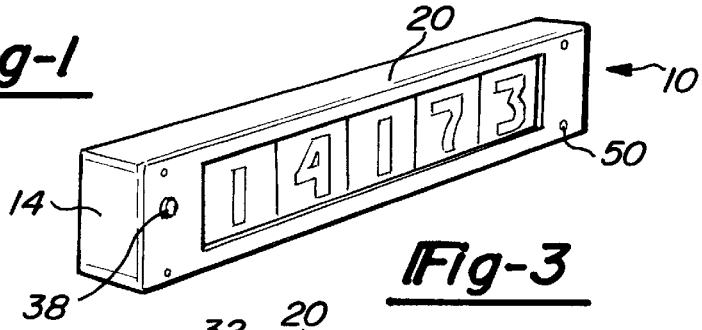
FIG. 3 is a perspective view of the street number display positioned in a horizon alignment.

A lighted street number display 10 in accordance with the invention is shown mounted on a building 12 is shown in FIG. 1. The street number display 10 may be mounted to display the street number in either a vertical alignment, as shown in FIG. 2, or a horizontal alignment, as shown in FIG. 3. The display 10 can be used to display the street numbers having from one to five characters, such as numbers or letters.

Figure 4:
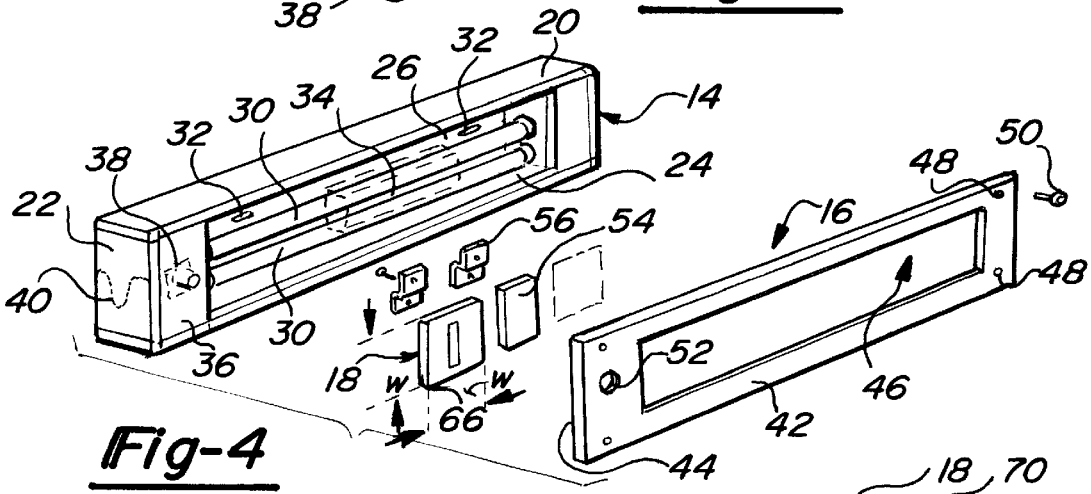
FIG. 4 is an exploded view of the street number display in accordance with invention.

As best shown in FIG. 4, the street number display includes a housing 14, a face plate 16, and a plurality of square character plates 18. The housing 14 includes a pair of long sides 20 and a pair of short sides 22 defining an opening 24 on one side. A back 26 covers the opposite side.

The back 26 has four apertures 32 provided for the mounting of the housing 14 to the building 12. The housing has an interior compartment 28 for mounting a light source, such as a pair of fluorescent bulbs 30, with sockets and a ballast 34.

A compartment 36 is formed at one end of the housing for mounting a light sensitive switch 38 which is connected to a power source, such as household current by wiring 40, to energize the bulbs 30 when the amount of daylight falls below a certain level. The housing 14 is formed of a rigid material such as molded or extruded plastic, metal, or composite material.

Figure 5:
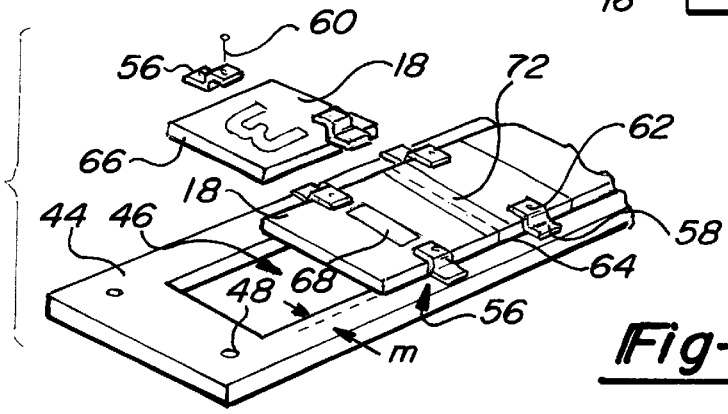
FIG. 5 is an exploded rear view of the face plate.

As shown in FIGS. 4 and 5, the face plate 16 has a front side 42, a rear side 44, and a rectangular opening 46. The face plate 16 has four holes 48 for receiving screws 50 to mount the face plate 16 to the housing. An aperture 52 is provided in the face plate 16 to receive a sensor of the light sensitive switch 38.

As best shown in FIG. 5, the character plates 18 and blank plates 54 are mounted to the rear side 44 of the face plate 16 with mounting clips 56. The clips 56 have offset arms. One arm 58 has an aperture for receiving a screw 60 to secure the clip to the rear side 44 of the face plate. The other arm 62 extends in an opposite direction from a standoff portion 64 to securely engage a portion of the character plate 18 or blank plate 54, as shown in FIG. 5. Alternatively, rails can be provided on either side of the opening 46 to form channels for sliding the character and blank plates into position.

Figure 6:
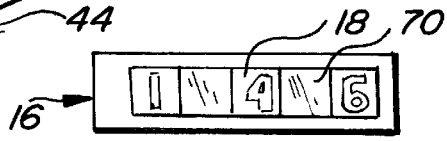
FIG. 6 is a front view of a face plate having both number plates and blank plates in accordance with the invention.

As shown in FIG. 4, 5, and 6, the character plates 18 are square, having pairs of side edges 66 which are spaced equal width "w". The blanks 18 are advantageously opaque and have a character portion 68 which is formed of a translucent material, such as clear plastic. The plate 18 can be numbered or lettered as shown in U.S. Pat. No. 3,968,584, or U.S. Pat. No. 4,254,457, so that the character portion 68 is translucent to permit light from the light source to pass through the character portion 68 of the character plate 18.

The rectangular opening 46 of the face plate 44 has a width "w" smaller than the width of the character plate 18 to provide a margin "m" to hold the peripheral portion of the character plates. Thus, the width of the opening is w−2m. Likewise, the opening has a length less than the a whole number multiple of the width "w" of the character blank (such as 5w) less twice the margin distance, or 5w−2m.

Additionally, square opaque blank plates 70 and rectangular opaque blank plates 54 cover the opening when the street number has less than five characters, such as four characters shown in FIG. 2 and three characters shown in FIG. 6. For three character street numbers, the square blank plates 70 may be placed between the character plates 18 as shown in FIG. 6 or positioned on either end of a group of the three character plates 18. For four character numbers, such as shown in FIG. 2, rectangular blank plates 54 are interposed between pairs of the character plates 18. The rectangular blank plates 54 have a width which is ⅓ the length "w". Alternatively, blank plates having ½ the length "w" may be positioned on either end of the four character plate street number. A strip 72 of opaque material may be adhered to the back of the plates 18, 54, 70, to block any light from passing between the blanks.

Having described my invention, however, many modifications thereto may become apparent to those skilled in the art. These and other changes are within the spirit of the invention as defined by the scope of the appended claims.

I claim:

1. A street number display comprising:

an elongated housing;

a light source mounted within said housing;

a plurality of square plates, each of said square plates having a pair of opposed horizontal sides and a pair of opposed vertical sides, and having an opaque portion and a translucent portion to permit light to pass through to form a character;

means for mounting said plurality of square plates to said housing in a horizontally arranged position and a vertically arranged position, when mounted in said horizontally arranged position each of said plurality of plates has at least one vertical side abuttng at least one vertical side of an adjacent plate, when mounted in said vertically arranged position each of said plurality of plates has at least one horizontal side abutting at least one horizontal side of an adjacent plate;

means for mounting said housing to a building, said means for mounting maintaining said plurality of plates to form a vertically aligned street number when said plurality of plates are in said vertically arranged position and said means for mounting maintaining said plurality of plates to form a horizontally aligned street number when said plurality of plates is in said horizontally arranged position.

2. The display of claim 1 further comprising a face plate mounted to said housing, said face plate having a rectangular opening and a rear side.

3. The display of claim 2, further comprising at least one clip for mounting said plurality of square plates to said face plate.

4. A display according to claim 1, further comprising a light sensitive switch mounted to said housing for activating said light source.

5. A display according to claim 1, further comprising at least two opaque blank plates.

6. A display according to claim 1, wherein said plates are mounted to a rear side of said face plate.

7. The street display of claim 1 further comprising at least one opaque plate mounted to said housing and interspaced between said plurality of square plates.

* * * * *

UNITED STATES PATENT AND TRADEMARK OFFICE

CERTIFICATE OF CORRECTION

PATENT NO. : 5,890,306

DATED : April 6, 1999

INVENTOR(S) : Patric Nelson Smith

It is certified that error appears in the above-identified patent and that said Letters Patent is hereby corrected as shown below:

Column 1, line 37, delete"utilize" and insert --utilizes--;
line 50, after "either", insert --"a"--.

Column 2, line 2, after "with", insert --the--;
line 10, after "building 12", delete "is shown";
line 54, delete "blanks" insert --plates--;
line 61, delete "44", insert --16--;
line 65, after "than", delete "the".

Signed and Sealed this

Twenty-seventh Day of July, 1999

*Attest:*

Q. TODD DICKINSON

*Attesting Officer*

*Acting Commissioner of Patents and Trademarks*